US011371520B2

(12) United States Patent
Shih

(10) Patent No.: US 11,371,520 B2
(45) Date of Patent: Jun. 28, 2022

(54) FLUID DYNAMIC-PRESSURE BEARING SET FOR A FAN

(71) Applicant: John Wun-Chang Shih, Hsinchu County (TW)

(72) Inventor: John Wun-Chang Shih, Hsinchu County (TW)

( * ) Notice: Subject to any disclaimer, the term of this patent is extended or adjusted under 35 U.S.C. 154(b) by 32 days.

(21) Appl. No.: 16/935,186

(22) Filed: Jul. 21, 2020

(65) Prior Publication Data

US 2022/0025895 A1 Jan. 27, 2022

(51) Int. Cl.
*F04D 29/047* (2006.01)
*F04D 25/06* (2006.01)
*F04D 19/00* (2006.01)

(52) U.S. Cl.
CPC ..... *F04D 29/047* (2013.01); *F04D 19/002* (2013.01); *F04D 25/06* (2013.01); *F04D 25/062* (2013.01)

(58) Field of Classification Search
CPC .. F04D 29/057; F04D 29/0513; F04D 29/063; F04D 29/0413; F04D 29/522; F04D 19/002; H02K 5/04; H02K 7/14; F16C 17/02026; F16C 35/02; F16C 41/00; F16C 43/02; B29L 2031/04
See application file for complete search history.

(56) References Cited

U.S. PATENT DOCUMENTS

2010/0086395 A1* 4/2010 Li ..... F04D 29/023 415/177
2012/0294556 A1* 11/2012 Kurimura ..... F16C 33/74 384/107

* cited by examiner

*Primary Examiner* — Kenneth J Hansen

(57) ABSTRACT

A fluid dynamic-pressure bearing set for a fan includes a casing having a hollow inner space; a seat integrally formed with the casing; the seat including a lower plate, and a hollow cylinder extended from the lower plate of the seat; a friction sheet being installed on the lower plate of the seat; a bearing being installed around an inner periphery of the cylinder; a motor coil installed around an outer periphery of the cylinder; a rotary shaft installed in an axial center of the bearing; and a fan blade set installed at an upper portion of the rotary shaft; and wherein a recess is formed on the lower plate of the seat and does not penetrate the bottom of the seat; and the recess is positioned between the friction sheet and an inner wall of the seat.

2 Claims, 3 Drawing Sheets

FLUID DYNAMIC-PRESSURE BEARING SET FOR A FAN

FIELD OF THE INVENTION

The present invention relates to fans, and in particular to a fluid dynamic-pressure bearing set for a fan.

BACKGROUND OF THE INVENTION

In general, a fluid dynamic-pressure bearing set of a fan includes the following elements. A casing has a hollow inner space. A seat is integrally formed with the casing. A bearing is installed within the seat. A motor coil is installed around the seat. A rotary shaft is installed at a center of the bearing. A fan blade set is installed at a portion of the rotary shaft. The portion of the rotary shaft protrudes out of the bearing.

However, in the prior art, the bearing is assembled to the seat. After assembly, it cannot check whether the bearing and the rotary shaft are not in contact because the bearing is tightly sealed within the seat and the periphery thereof is enclosed by the motor coil and the upper side is hindered by the fan. If it is desired to check this state, it is needed to detach the related elements.

SUMMARY OF THE INVENTION

Accordingly, the object of the present invention is to provide a fluid dynamic-pressure bearing set for a fan, wherein by the recess, if it is to check whether the bearing is in contact with the rotary shaft, it is only to penetrate the recess and then an electric wire passes through the penetrated recess for checking whether the bearing is in contact with the rotary shaft. However, the structure of the present invention is simple with a lower cost and the checking work can be performed easily and quickly.

To achieve above object, the present invention provides a fluid dynamic-pressure bearing set for a fan, comprising: a casing having a hollow inner space; a seat integrally formed with the casing; the seat including a lower plate, and a hollow cylinder extended from the lower plate of the seat; a friction sheet being installed on the lower plate of the seat and being within the hollow cylinder of the seat; a bearing being installed around an inner periphery of the cylinder of the seat; a motor coil installed around an outer periphery of the cylinder of the seat; a rotary shaft installed in an axial center of the bearing; and a fan blade set installed at an upper portion of the rotary shaft; the upper portion of the rotary shaft protruding out of the bearing; and wherein a recess is formed on the lower plate of the seat and does not penetrate the bottom of the seat; and the recess is positioned between the friction sheet and an inner wall of the seat.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
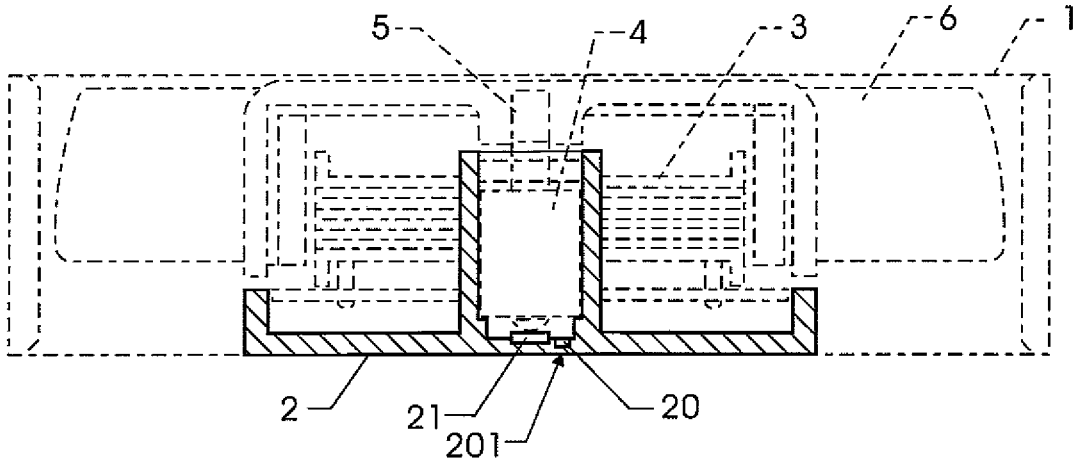
FIG. 1 is a schematic cross sectional view of the present invention.
Figure 3:
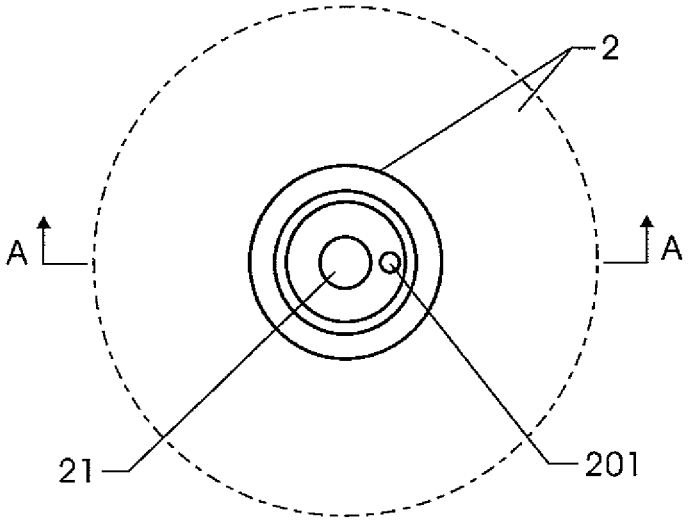
FIG. 3 is an elevation view of FIG. 2.
Figure 2:
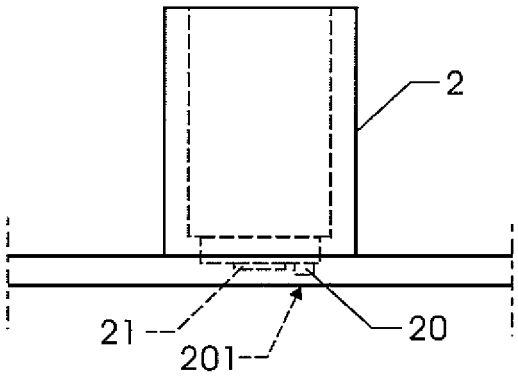
FIG. 2 is a front view of the present invention.
Figure 4:
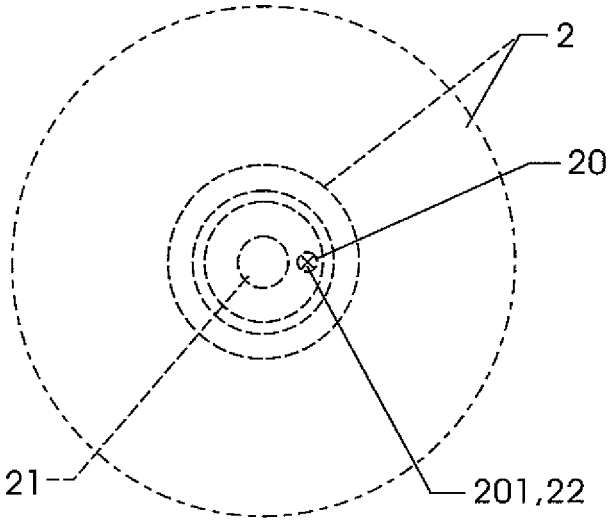
FIG. 4 is an upper view of FIG. 2.
Figure 5:
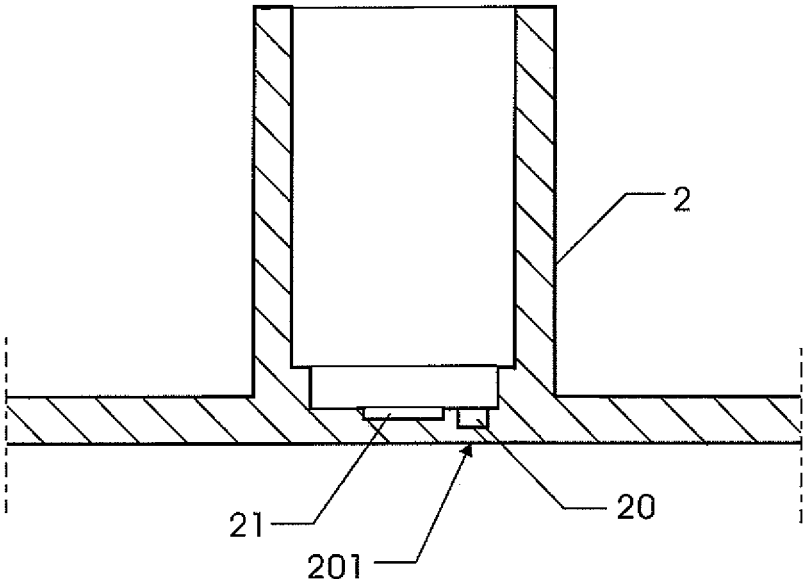
FIG. 5 is an enlarged cross sectional view along line A-A of FIG. 3.

With reference to FIG. 1, the structure of the fluid dynamic-pressure bearing set of the present invention is illustrated. The present invention includes the following elements.

A casing 1 has a hollow inner space.

A seat 2 is integrally formed with the casing 1. The seat includes a lower plate, and a hollow cylinder extended from the lower plate of the seat 2. A friction sheet 21 is installed on the lower plate of the seat 2 and is within the hollow cylinder of the seat 2.

A bearing 4 is installed around an inner periphery of the cylinder of the seat 2.

A motor coil 3 is installed around an outer periphery of the cylinder of the seat 2.

A rotary shaft 5 is installed in an axial center of the bearing 3.

A fan blade set 6 is installed at an upper portion of the rotary shaft 5. The upper portion of the rotary shaft 5 protrudes out of the bearing 4.

With reference to FIGS. 2 to 5, a recess 20 is formed on the lower plate of the seat 2 and does not penetrate the bottom of the seat 2. The recess 20 is positioned between the friction sheet 21 and an inner wall of the seat 2. A bottom side of a bottom wall 22 of the lower plate of the seat 2 is formed with an indication 201 which indicates a position of the recess 20, that is the indication 201 is positioned at an opposite side of the recess 20. Therefore in checking, the recess 20 can be penetrated from the bottom wall 22 of the recess 20 by the assistance of the indication 201. However, a thickness of the bottom wall 22 is smaller than or equal to a thickness of the bottom plate of the seat 2.

Therefore by the recess 20, if it is to check whether the bearing is in contact with the rotary shaft, it is only to penetrate the recess and then an electric wire passes through the penetrated recess for checking whether the bearing is in contact with the rotary shaft. However, the structure of the present invention is simple with a lower cost and the checking work can be performed easily and quickly.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A fluid dynamic-pressure bearing set for a fan comprising:

a casing having a hollow inner apace;

a seat integrally formed with the casing; the seat including a lower plate, and a hollow cylinder extended from the lower plate of the seat; a friction sheet being installed on the lower plate of the seat and being within the hollow cylinder of the seat;

a bearing being installed around an inner periphery of the cylinder of the seat;

a motor coil installed around an outer periphery of the cylinder of the seat;

a rotary shaft installed in an axial center of the bearing; and a fan blade set installed at an upper portion of the rotary shaft; the upper portion of the rotary shaft protruding out of the bearing; and wherein a recess is formed on the lower plate of the seat and does not penetrate the bottom of the seat; and the recess is positioned between the friction sheet and an inner wall of the seat; and wherein a bottom side of a bottom wall of the lower plate of the seat is formed with an indication which indicates a position of the recess; wherein the indication is positioned at an opposite side of the recess.

2. The fluid dynamic-pressure bearing set for a fan as claimed in claim 1, wherein a thickness of the bottom wall is smaller than or equal to a thickness of the lower plate of the seat.

* * * * *